US009375827B2

(12) United States Patent
Amundsen et al.

(10) Patent No.: US 9,375,827 B2
(45) **Date of Patent: *Jun. 28, 2016**

(54) METHODS TO REPAIR WORN OR ERODED PDC CUTTERS, CUTTERS SO REPAIRED, AND USE OF REPAIRED PDC CUTTERS IN DRILL BITS OR OTHER TOOLS

(71) Applicant: Varel International Ind., L.P., Carrollton, TX (US)

(72) Inventors: Marvin Windsor Amundsen, Houston, TX (US); Charles Daniel Johnson, Porter, TX (US)

(73) Assignee: Varel International Ind., L.P., Carrollton, TX (US)

( * ) Notice: Subject to any disclaimer, the term of this patent is extended or adjusted under 35 U.S.C. 154(b) by 127 days.

This patent is subject to a terminal disclaimer.

(21) Appl. No.: 14/139,302

(22) Filed: Dec. 23, 2013

(65) Prior Publication Data

US 2014/0158436 A1 Jun. 12, 2014

Related U.S. Application Data

(63) Continuation-in-part of application No. 13/924,418, filed on Jun. 21, 2013.

(60) Provisional application No. 61/663,205, filed on Jun. 22, 2012.

(51) Int. Cl.

| | |
|---|---|
| ***B24D 18/00*** | (2006.01) |
| ***E21B 10/573*** | (2006.01) |
| ***E21B 10/567*** | (2006.01) |
| *E21B 10/56* | (2006.01) |

(52) U.S. Cl.

CPC ..... *B24D 18/0054* (2013.01); *E21B 10/567* (2013.01); *E21B 10/5735* (2013.01); *E21B 2010/561* (2013.01)

(58) Field of Classification Search

CPC ..... E21B 10/567; E21B 10/5735; E21B 2010/561; E21B 10/573; E21B 10/46; B24D 18/0054; B24D 18/00; C22C 19/058; B23K 35/3033; Y10T 29/49746; Y10T 408/26

See application file for complete search history.

(56) References Cited

U.S. PATENT DOCUMENTS

| | | | |
|---|---|---|---|
| 5,609,286 | A | 3/1997 | Anthon |
| 5,957,365 | A | 9/1999 | Anthon |

(Continued)

FOREIGN PATENT DOCUMENTS

| | | |
|---|---|---|
| CA | 1235049 | 4/1988 |
| EP | 0501447 | 9/1992 |

OTHER PUBLICATIONS

Copenheaver, Blain R., International Search Report and Written Opinion issued in PCT/US/2014/070952, 7 pages, completed on Feb. 20, 2015, mailed on Apr. 1, 2015.

*Primary Examiner* — Yong-Suk (Philip) Ro

(57) ABSTRACT

A repaired polycrystalline diamond cutter and method for fabricating the same. The cutter includes a damaged substrate that includes at least one void therein, a polycrystalline diamond table coupled to the damaged substrate, and a paste compound disposed within the voids formed about the damaged substrate. The damaged substrate and the paste compound collectively form a full circumference. The method includes obtaining a damaged cutter that includes a polycrystalline diamond table coupled to a damaged substrate having at least one void formed therein, applying a paste compound within the at least one void, melting the paste compound via induction heating, bonding the paste compound to the substrate and forming a processed PDC cutter, and grinding at least a portion of the paste compound from the processed PDC cutter to form the repaired cutter.

23 Claims, 10 Drawing Sheets

(56) References Cited

U.S. PATENT DOCUMENTS

| | | | | |
|---|---|---|---|---|
| 8,863,864 | B1 * | 10/2014 | Miess | 175/374 |
| 2005/0087371 | A1 | 4/2005 | Kembaiyan | |
| 2006/0165973 | A1 | 7/2006 | Dumm et al. | |
| 2008/0283305 | A1 | 11/2008 | Overstreet et al. | |
| 2009/0032310 | A1 | 2/2009 | Stevens et al. | |
| 2010/0282519 | A1 | 11/2010 | Zhang et al. | |
| 2011/0171414 | A1 | 7/2011 | Sreshta et al. | |

* cited by examiner

METHODS TO REPAIR WORN OR ERODED PDC CUTTERS, CUTTERS SO REPAIRED, AND USE OF REPAIRED PDC CUTTERS IN DRILL BITS OR OTHER TOOLS

CROSS-REFERENCE TO RELATED APPLICATIONS

The present application is a continuation-in-part of U.S. patent application Ser. No. 13/924,418, entitled "Methods to Repair Worn or Eroded PDC Cutters, Cutters So Repaired, and Use of Repaired PDC Cutters In Drill Bits or Other Tools," and filed on Jun. 21, 2013, which claims priority to U.S. Provisional Patent Application No. 61/663,205, entitled "Methods to Repair Worn or Eroded PDC Cutters, Cutters So Repaired, and Use of Repaired PDC Cutters In Drill Bits or Other Tools," filed June 22, 2012, the disclosures of which are incorporated by reference herein.

BACKGROUND

This invention relates generally to polycrystalline diamond compact ("PDC") cutters. More particularly, this invention relates to methods to repair worn or eroded PDC cutters, the repaired cutters, and use of the repaired cutters in drill bits and/or other tools.

FIG. 1 shows a perspective view of a drill bit 100 in accordance with the prior art. Referring to FIG. 1, the drill bit 100 includes a bit body 110 that is coupled to a shank 115. The shank 115 includes a threaded connection 116 at one end 120. The threaded connection 116 couples to a drill string (not shown) or some other equipment that is coupled to the drill string. The threaded connection 116 is shown to be positioned on the exterior surface of the one end 120. This positioning assumes that the drill bit 100 is coupled to a corresponding threaded connection located on the interior surface of a drill string (not shown). However, the threaded connection 116 at the one end 120 is alternatively positioned on the interior surface of the one end 120 if the corresponding threaded connection of the drill string (not shown) is positioned on its exterior surface in other exemplary embodiments. A bore (not shown) is formed longitudinally through the shank 115 and the bit body 110 for communicating drilling fluid from within the drill string to a drill bit face 111 via one or more nozzles 114 during drilling operations.

The bit body 110 includes a plurality of blades 130 extending from the drill bit face 111 of the bit body 110 towards the threaded connection 116. The drill bit face 111 is positioned at one end of the bit body 110 furthest away from the shank 115. The plurality of blades 130 form the cutting surface of the drill bit 100, which may be an infiltrated matrix drill bit. One or more of these plurality of blades 130 are either coupled to the bit body 110 or are integrally formed with the bit body 110. A junk slot 122 is formed between each consecutive blade 130, which allows for cuttings and drilling fluid to return to the surface of the wellbore (not shown) once the drilling fluid is discharged from the nozzles 114. A plurality of cutters 140 are coupled to each of the blades 130 within the sockets 180 formed therein, and extend outwardly from the surface of the blades 130 to cut through earth formations when the drill bit 100 is rotated during drilling. One type of cutter 140 used within the drill bit 100 is a PDC cutter; however other types of cutters are contemplated as being used within the drill bit 100. The cutters 140 and portions of the bit body 110 deform the earth formation by scraping and/or shearing. The cutters 140 and portions of the bit body 110 are subjected to extreme forces and stresses during drilling which causes the surface of the cutters 140 and the bit body 110 to wear. Eventually, the surfaces of the cutters 140 and the bit body 110 wear to an extent that the drill bit 100 is no longer useful for drilling and is either repaired or discarded depending upon the type of damage and/or the extent of the damage. Although one embodiment of the drill bit has been described, other drill bit embodiments or other downhole tools that use PDC cutters, which are known to people having ordinary skill in the art, are applicable to exemplary embodiments of the present invention.

FIGS. 2A and 2B show various views of a PDC (Polycrystalline Diamond Compact) cutter 140 in accordance with the prior art. FIG. 2A is a perspective view of the PDC cutter 140 in accordance with the prior art. FIG. 2B is a side view of the PDC cutter 140 in accordance with the prior art. These PDC (Polycrystalline Diamond Compact) cutters 140 are commonly used in oil and gas drill bits 100 (FIG. 1), and in other downhole tools. Referring to FIGS. 2A and 2B, the PDC cutters 140 provide a superhard material layer 210, such as a diamond table, which has been fused at high pressure and high temperature ("HPHT") to a metal backing, or substrate 220, typically tungsten carbide. The PCD cutting table 210, or diamond table, is about one hundred thousandths of an inch (2.5 millimeters) thick; however, the thickness is variable depending upon the application in which the PCD cutting table 210 is to be used. The substrate 220 includes a top surface 222, a bottom surface 224, and a substrate outer wall 226 that extends from the circumference of the top surface 222 to the circumference of the bottom surface 224. The PCD cutting table 210 includes a cutting surface 212, an opposing surface 214, and a PCD cutting table outer wall 216. The PCD cutting table outer wall 216 is substantially perpendicular to the plane of the cutting surface 212 and extends from the outer circumference of the cutting surface 212 to the circumference of the opposing surface 114. The opposing surface 214 of the PCD cutting table 210 is coupled to the top surface 222 of the substrate 220. According to some exemplary embodiments, the cutting surface 212 is formed with at least one bevel (not shown) along the circumference of the cutting surface 212.

Upon coupling the PCD cutting table 210 to the substrate 220, the cutting surface 212 of the PCD cutting table 210 is substantially parallel to the substrate's bottom surface 224. Additionally, the PDC cutter 140 has been illustrated as having a right circular cylindrical shape; however, the PDC cutter 140 is shaped into other geometric or non-geometric shapes in other examples. In certain examples, the opposing surface 214 and the top surface 222 are substantially planar; however, the opposing surface 214 and/or the top surface 222 is non-planar and complementary in shape in other examples.

The PDC cutters 140 are expensive to manufacture and constitute a significant portion of the cost of PDC mounted bits 100 (FIG. 1) and tools. PDC cutters 140 are typically brazed into sockets 180 (FIG. 1) formed in the body of a bit 100 (FIG. 1) or tool. This braze joint is frequently the "weak link" in the durability of the tool. A good braze joint requires a very narrow clearance between the socket 180 (FIG. 1) and the PDC cutter 140 that is being brazed into it. A clearance in the range of .005 inches or less is desired between the socket 180 (FIG. 1) and the PDC cutter 140 when positioned within the socket 180 (FIG. 1) prior to applying the braze material. A looser fit, i.e. a large clearance, can weaken the braze joint and result in the loss of the PDC cutter 140 in application, thereby shortening the useful life of the bit 100 (FIG. 1) or tool.

FIGS. 3A-3E show several views of damaged PDC cutters 300, 310, 320, 330 in accordance with the prior art. FIG. 3A is a perspective view of a damaged PDC cutter 300 that is heavily worn and eroded in accordance with the prior art.

FIG. 3B is a perspective view of a damaged PDC cutter 310 that is slightly eroded in accordance with the prior art. FIG. 3C is a perspective view of a damaged PDC cutter 320 that is heavily eroded in accordance with the prior art. FIG. 3D is a perspective view of a damaged PDC cutter 330 that is eroded in accordance with the prior art. FIG. 3E is a side view of the damaged PDC cutter 330 in accordance with the prior art. Referring to FIGS. 3A-3E, some damaged PDC cutters 310 that have been slightly worn or eroded have historically been rotated to a "full cylinder" section of the tungsten carbide substrate 220 to be reused while orienting a virgin diamond cutting edge towards the formation. If the damaged PDC cutters 300, 320, 330 are too heavily worn or eroded, such as that shown in FIGS. 3A, 3C, 3D, and 3E, the damaged cutters 300, 320, 330 typically are discarded as scrap. In some instances the scrapped cutters 300, 320, 330 have been reclaimed by using wire EDM to cut out a smaller diameter cylinder to make a recovered smaller diameter cutter (not shown). This method does not allow for the direct reuse of the cutter in a similar bit or tool, but instead, the recovered smaller diameter cutter must be deployed in a tool that can economically accommodate the smaller diameter cutter, i.e. has a pocket dimensioned to fit and use the smaller diameter cutter.

The decision as to whether or not a worn or eroded cutter is reused, rotated, or discarded has been based in part on the condition of the remaining tungsten carbide substrate. The criterion depends on the amount of full cylinder substrate remaining If an insufficient amount of full cylinder substrate remains to allow for a strong braze joint when oriented with a fresh diamond edge towards the formation, then the cutter is typically scrapped or reprocessed as described above.

BRIEF DESCRIPTION OF THE DRAWINGS

The foregoing and other features and aspects of the invention will be best understood with reference to the following description of certain exemplary embodiments of the invention, when read in conjunction with the accompanying drawings, wherein.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

This invention relates generally to PDC cutters. More particularly, this invention relates to methods to repair worn or eroded PDC cutters, the repaired cutters, and use of the repaired cutters in drill bits and/or other tools. Although the description provided below is related to a PDC cutter, exemplary embodiments of the invention relate to any cutter having a substrate and a superhard material layer, such as a diamond table, attached thereto.

Figure 4:
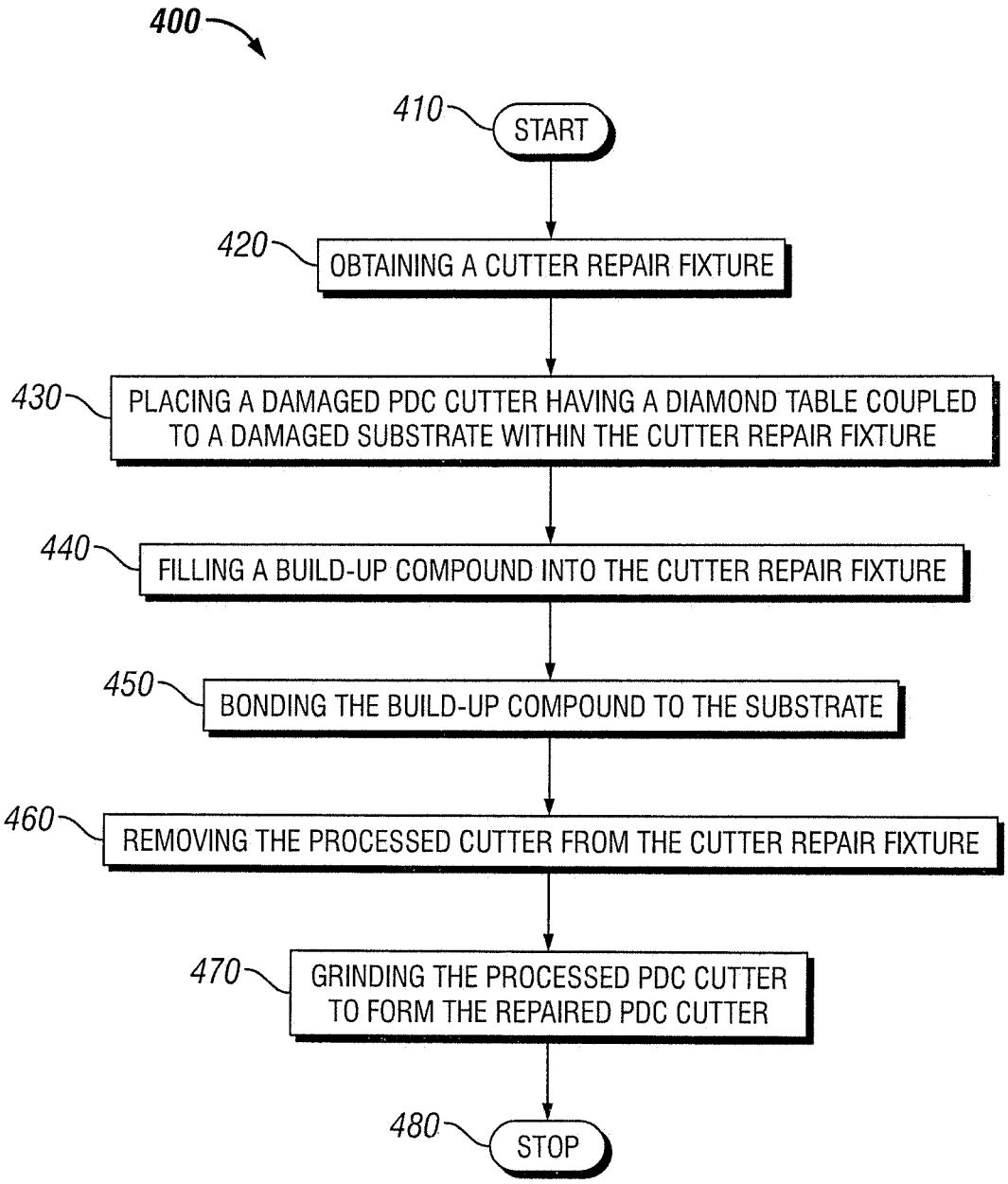
FIG. 4 is a flow chart illustrating a method for repairing a damaged PDC cutter, such as the PDC cutters of FIGS. 3A-3E, in accordance with an exemplary embodiment of the present invention.
Figure 5:
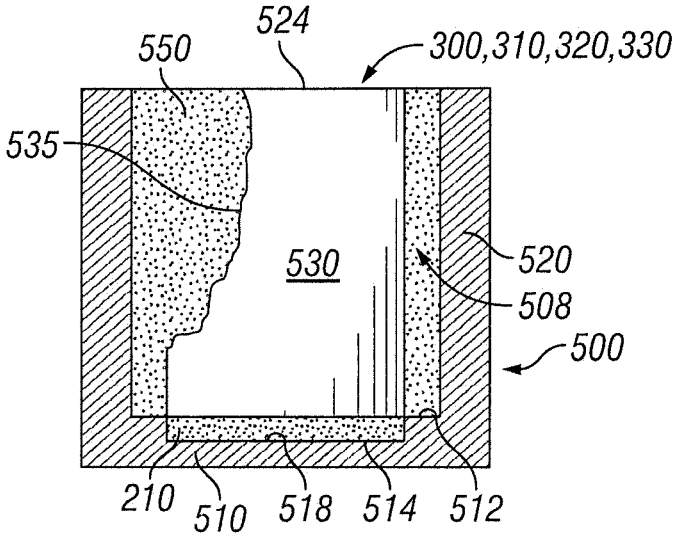
FIG. 5 is a cross-sectional view of a cutter repair fixture that has a damaged PDC cutter of FIGS. 3A-3E and a build-up compound disposed therein in accordance with an exemplary embodiment of the present invention.

FIG. 4 is a flow chart illustrating a method 400 for repairing a damaged PDC cutter 300, 310, 320, 330 such as PDC cutters 300, 310, 320, 330 (FIGS. 3A-3E), in accordance with an exemplary embodiment of the present invention. FIG. 5 is a cross-sectional view of a cutter repair fixture 500 that has a damaged PDC cutter 300, 310, 320, 330 and a build-up compound 550 disposed therein in accordance with an exemplary embodiment of the present invention. Referring to FIGS. 4 and 5, the method 400 and the associated components for performing method 400 are illustrated and described herein. Method 400 starts at step 410. After step 410, a cutter repair fixture 500 is obtained at step 420.

Figure 2A:
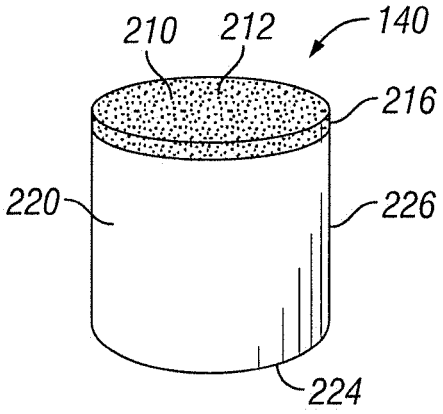
FIG. 2A (Prior Art)
FIGS. 2A and 2B show various views of a PDC cutter in accordance with the prior art.
Figure 2B:
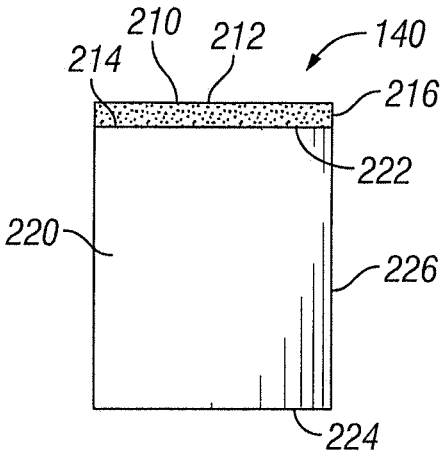
FIG. 2B (Prior Art)
Figure 3A:
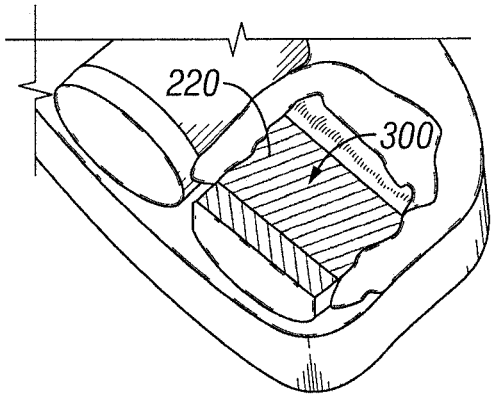
FIG. 3A (Prior Art)
FIGS. 3A-3E show several perspective views of damaged PDC cutters in accordance with the prior art.
Figure 3B:
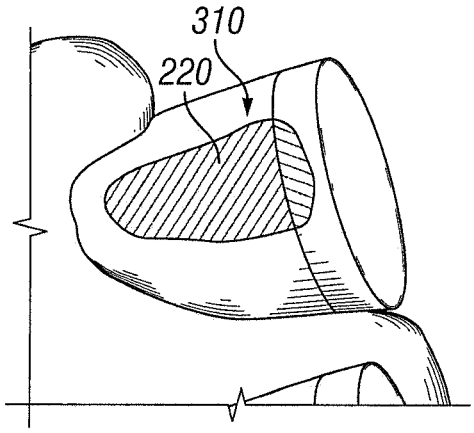
FIG. 3B (Prior Art)
Figure 3C:
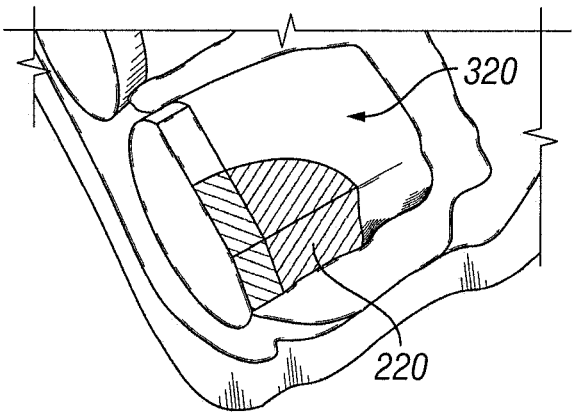
FIG. 3C (Prior Art)
Figure 3D:
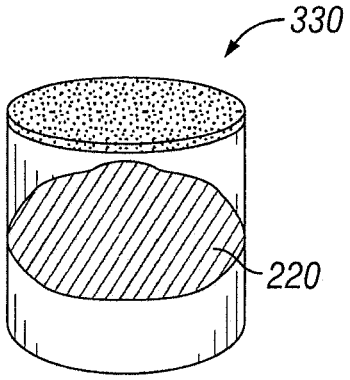
FIG. 3D (Prior Art)
Figure 3E:
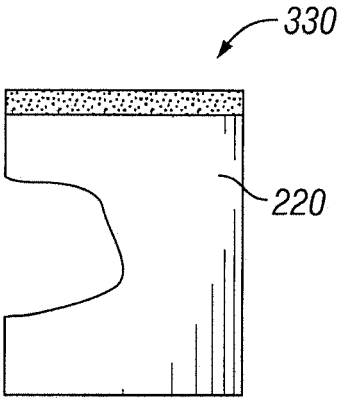
FIG. 3E (Prior Art)

According to some exemplary embodiments, the cutter repair fixture 500 includes a base 510 and at least one sidewall 520 extending substantially orthogonally away from the base 510, thereby forming a first cavity 508 therein. According to certain exemplary embodiments, the base 510 and the at least one sidewall 520 are formed as a single component; however, in other exemplary embodiments, the base 510 and the sidewalls 520 are formed separately and thereafter coupled together, such as by being threadedly coupled together. The first cavity 508 forms a substantially cylindrical shape; however, in some alternative exemplary embodiments, the first cavity 508 forms a different geometric or non-geometric shape, such as a tubular shape having a square, rectangular, triangular, or other non-geometric cross-sectional shape. The height of the first cavity 508 is similar to, or greater than, the height of the substrate 530, which is similar to substrate 220 (FIGS. 2A and 2B) and is therefore not described again in detail herein for the sake of brevity, and the circumference of the first cavity 508 is larger than the circumference of the substrate 530.

According to some exemplary embodiments, the base 510 includes an interior surface 512 that is non-planar and defines a portion of the first cavity 508. The interior surface 512 includes a second cavity 514 formed therein extending inwardly from a portion of the interior surface 512 of the base 510. The second cavity 514 is fluidly coupled to the first cavity 508. According to certain exemplary embodiments, the second cavity 514 is cylindrically shaped and is dimensioned to receive the diamond table 210 of the damaged PDC cutter 300, 310, 320, 330. Thus, the height of the second cavity 514 is similar to the thickness of the diamond table 210 and the circumference of the second cavity 514 is similar to, but slightly larger than, the circumference of the diamond table 210. In certain exemplary embodiments, the diameter of the first cavity 508 is slightly larger than the diameter of the second cavity 514.

The cutter repair fixture 500 is fabricated using a suitable material capable of withstanding temperatures used in the repair method 400. The temperatures used in the repair method 400 are dependent upon the type of build-up compound 550 that is used and the melting temperatures of these build-up compounds 550. For example, the cutter repair fixture 500 is exposed to temperatures reaching up to about 700 degrees Celsius in some exemplary embodiments, while in other exemplary embodiments, the cutter repair fixture 500 is exposed to temperatures reaching greater than 700 degrees Celsius. In exemplary embodiments where the diamond table 210 is exposed to temperatures of about 700 degrees Celsius or greater, at least the base 510 of the cutter repair fixture 500, and the sidewalls 520 in some exemplary embodiments, is fabricated using a heat sink material, such as aluminum or some other metal or metal alloy, that has a high heat transfer coefficient to keep the diamond table 210 at a temperature below 750 degrees Celsius. Further, the base 510, and optionally the sidewalls 520, are fabricated to include fins (not shown) pursuant to some exemplary embodiments. According to certain alternative exemplary embodiments, a heat sink (not shown), which optionally includes fins, is thermally coupled to at least the base 510 of the cutter repair fixture 500 to keep the diamond table 210 at a temperature below 750 degrees Celsius. The heat sink is optionally used even if the diamond table 210 is exposed to only temperatures less than 700 degrees Celsius. Although one example of a cutter repair fixture has been described herein, alternative types of cutter repair fixtures that are obvious variants to the cutter repair fixture 500 can be used in alternative exemplary embodiments.

After step 420, a damaged PDC cutter 300, 310, 320, 330 having a diamond table 210 coupled to a damaged substrate 530 is placed within the cutter repair fixture 500 at step 430. The damaged PDC cutter 300, 310, 320, 330 is typically worn or eroded in at least the substrate 530. The diamond table 210 is oriented to be positioned and set within the second cavity 514, while the damaged substrate 530 is positioned within the first cavity 508. According to some exemplary embodiments, the damaged PDC cutter 300, 310, 320, 330 is cleaned prior to being placed within the cutter repair fixture 500.

Figure 1:
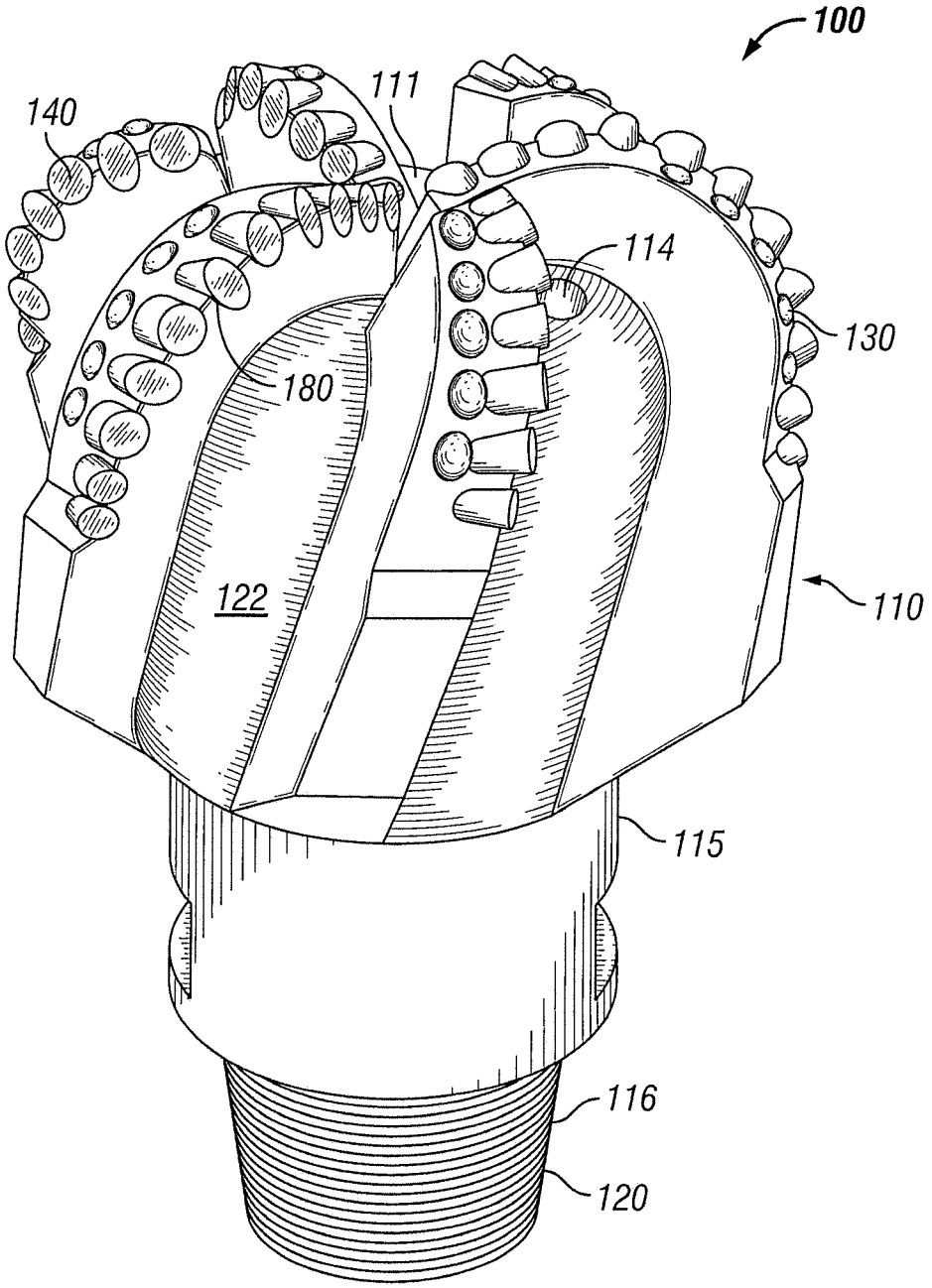
FIG. 1 (Prior Art)
FIG. 1 shows a perspective view of a drill bit in accordance with the prior art.

After step 430, the buildup compound 550 is filled into the cutter repair fixture 500 at step 440. The build-up compound 550 is a material capable of being bonded to the substrate 530, which for example is fabricated from tungsten carbide or tungsten carbide matrix. The build-up compound 550 is any element or combination of elements with a melting point higher than the liquidus temperature of the braze filler material that is used to braze the repaired PDC cutter 600 (FIGS. 6A and 6B) into a cutter pocket, or socket 180 (FIG. 1), formed in the bit 100 (FIG. 1). An example of the build-up compound 550 includes a metallic material that includes at least one of a silver, silver compound, nickel, nickel compound, chrome, boron, and silicon mix. According to some exemplary embodiments, the build-up compound 550 includes an amount of tungsten carbide. In certain alternative exemplary embodiments, several alternative material mixes are used for the buildup compound 550, as is known or become known to people having ordinary skill in the art having the benefit of the present disclosure.

After step 440, the build-up compound 550 is bonded to the substrate 530 at step 450. According to some exemplary embodiments, the cutter repair fixture 500 with the damaged PDC cutter 300, 310, 320, 330 and the build-up compound undergoes a microwave sintering process to bond the build-up compound 550 to the substrate 530 and fill the void in the worn or eroded PDC cutter 300, 310, 320, 330. Thus, a fresh thickness of metallic material, or buildup compound 550, is applied, or coupled, all around the outer circumference of the substrate 530 of the previously used and damaged PDC cutter 300, 310, 320, 330. Alternatively, according to other exemplary embodiments, other types of coupling processes, such as a spark sintering process or other known sintering processes having the benefit of the present disclosure, are used to bond the build-up compound 550 to the substrate 530 and form the processed PDC cutter within the cutter repair fixture 500. According to certain exemplary embodiments, the processed PDC cutter has a substrate with a diameter larger than the diameter of the associated diamond table 210. For example, the diameter of the substrate of the processed PDC cutter is substantially the same as the diameter of the first cavity 508.

After step 450 where the build-up compound 550 has coupled around the used PDC cutter 300, 310, 320, 330, the processed PDC cutter is removed from the cutter repair fixture 500 at step 460. According to some exemplary embodiments, the cutter repair fixture 500 is undamaged and reusable after the processed PDC cutter is removed from the cutter repair fixture 500. In other exemplary embodiments, cutter repair fixture 500 is damaged and not reusable once the processed PDC cutter is removed from the cutter repair fixture 500.

After step 460, the processed PDC cutter is grounded to form the repaired PDC cutter 600 (FIGS. 6A and 6B) at step 470. According to some exemplary embodiments, the processed PDC cutter is placed within an OD grinder (not shown) and OD grounded, or grounded around its outer diameter, to form the repaired PDC cutter 600 (FIGS. 6A and 6B), which is at or near the same outer diameter as the outer diameter of the PDC cutter prior to being damaged. When an OD grinder is used, a pressure cup, a partial pressure cup, or a shallow collet is used to hold the diamond cutting surface 518 of the cutter and a live center is optionally used to apply pressure to the bottom surface 524 of the cutter to hold it in place during the grinding operation. Optionally, the bottom surface 524, or back face, of the substrate 530 is ground flat and substantially parallel to the diamond cutting surface 518. However, in other exemplary embodiments, the bottom surface 524 of the substrate 530 is not ground flat and/or is not substantially parallel to the diamond cutting surface 518. Alternatively, in other exemplary embodiments, the processed PDC cutter is placed within a centerless grinder (not shown) or other appropriate shaping tool to return the outer diameter of processed PDC cutter to a value matching or close to matching the original diameter of the PDC cutter, thereby forming the repaired PDC cutter 600 (FIGS. 6A and 6B).

Figure 6A:
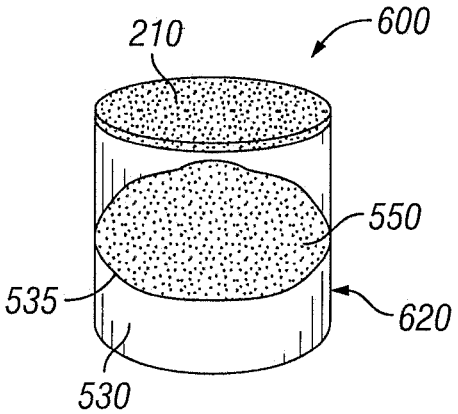
FIGS. 6A and 6B show various views of a repaired PDC cutter in accordance with an exemplary embodiment of the present invention.
Figure 6B:
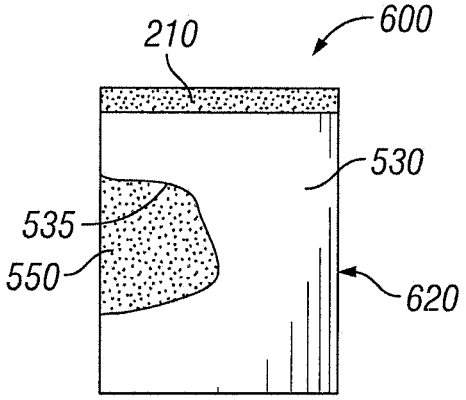

FIGS. 6A and 6B show various views of the repaired PDC cutter 600 in accordance with an exemplary embodiment of the present invention. The repaired PDC cutter 600 is similar to PDC cutter 140 except that the diamond table 210 is bonded to a repaired substrate 620. According to certain exemplary embodiments, the repaired substrate 620 includes a damaged substrate 530 having one or more voids 535 therein and the build-up compound 550 bonded to the damaged substrate 530 and disposed within the one or more voids 535 such that the damaged substrate 530 and the build-up compound 550 within the repaired substrate 620 collectively form a full cylindrical shape having a diameter equivalent to the diameter of the diamond table 210 when the diamond table 210 has not been damaged, or equivalent to the diameter of the original substrate prior to being damaged. According to certain exemplary embodiments, the circumference of both the diamond table 210 and the repaired substrate 620 are reduced from the original diameters such that the resulting substrate still includes some build-up compound 550.

After step 470, the repair method 400 stops at step 480. Although method 400 has been depicted herein with respect to certain steps, these steps are not limited to the order in which they are presented, but instead, may be performed in a different order in other exemplary embodiments. Further, some steps may be separated into additional steps. Alternatively, some steps may be combined into fewer steps. Furthermore, some steps may be performed in an entirely different manner than the example provided herein and are understood to be included within the exemplary embodiments.

In an alternative exemplary embodiment, the buildup compound 550 is bonded to the damaged PDC cutter 300, 310, 320, 330 via welding to fill in the voided area 535 in the damaged substrate 530. The welding method includes, but is not limited to, laser, plasma transfer arc, thermal plasma spray, or any other appropriate method known to people having ordinary skill in the art having the benefit of the present disclosure. According to the thermal plasma spray method, the buildup compound 550 is welded to the damaged PDC cutter 300, 310, 320, 330 to fill in the voided area 535 in the damaged substrate 530. A copper paste (not shown) is applied over the area that was sprayed with the buildup compound 550 according to certain exemplary embodiments. A flash heating is then performed with an induction unit (not shown), for example, which melts the copper and allows it to infiltrate into the buildup compound 550 that has filled the voided area 535, thereby forming the processed PDC cutter. This infiltration strengthens the bonding between the buildup compound 550 and the damaged substrate 530 of the damaged PDC cutter. Subsequently, a grinder or some other equipment, as previously mentioned, is used to grind the processed PDC cutter to the predetermined diameter, thereby forming the repaired PDC cutter 600. This predetermined diameter has been described above and is not described again for the sake of brevity. During the welding process, a heat sink is optionally placed in thermal contact with the diamond table 210, thereby maintaining the temperature of the diamond table to less than 700° C. The heat sink is a plate or a plate with fins according to some exemplary embodiments. Alternatively, the heat sink is a different shape. The heat sink is fabricated from copper, aluminum, or some other metal or metal alloy having a sufficient thermal coefficient capable of maintaining the temperature of the diamond table to less than 700° C.

According to either of the exemplary embodiments described above and/or any other alternative exemplary embodiments known to people having ordinary skill in the art having the benefit of the present disclosure, one or more additional processes described below is included therein. One process includes using a 3-D scanner (not shown) to scan the damage PDC cutter 300, 310, 320, 330 to determine the minimum amount, or volume, of build-up compound 550 needed and where the build-up compound 550 is needed so that excess build-up compound 550 is not used. Determining the minimum amount, or volume, of build-up compound 550 needed reduces costs by not wasting the build-up compound 550. Hence, less build-up compound 550 is removed during the grinding step. Another process includes dipping at least the damaged portion, or voided area 535, of the damaged PDC cutter 300, 310, 320, 330 into melted cobalt, thereby having the cobalt provide a coating along the damaged, or voided area 535. The coated PDC cutter is placed in the cutter repair fixture 500, or a crucible, fabricated from either ceramic, graphite, or some other suitable material. The build-up compound 550 is packed into the cutter repair fixture 500, or the crucible, and into the damaged portion, or voided area 535, to reform the damaged PDC cutter 300, 310, 320, 330 into the dimensions of the repaired PDC cutter 600. Induction heating is applied onto the processed PDC cutter, thereby forming the repaired PDC cutter 600. The cobalt intermediate coating facilitates the coupling of the build-up compound 550 to the damaged substrate 530 of the damaged PDC cutter 300, 310, 320, 330. In another process, the temperature of the diamond layer 210 is maintained to be less than 700° C. according to some exemplary embodiments. If the temperature of the diamond layer 210 reached 700° C. or higher, the diamond layer 210 has chances to be damaged. For example, graphitization can occur at these elevated temperatures. Thus, in some exemplary embodiments, the build-up compound 550 used has a melting temperature that is less than 700° C., or is at a temperature that prevents the diamond layer 210 from reaching above 700° C. during the repair method 400, or during any of the other alternative exemplary embodiments. The welding process is controlled to ensure that the temperature of the diamond layer 210 remains below 700° C.

However, in certain exemplary embodiments, the cutter repair fixture 500, as previously mentioned, includes a heat sink (not shown) adjacent to the diamond table 210 to keep the polycrystalline diamond layer 210 from overheating and suffering thermal damage during the repair operation. This heat sink is included when the melting temperature of the build-up compound 550 is equal to or higher than 700° C. and is optionally included when the melting temperature of the build-up compound 550 is less than 700° C.

Figure 7:
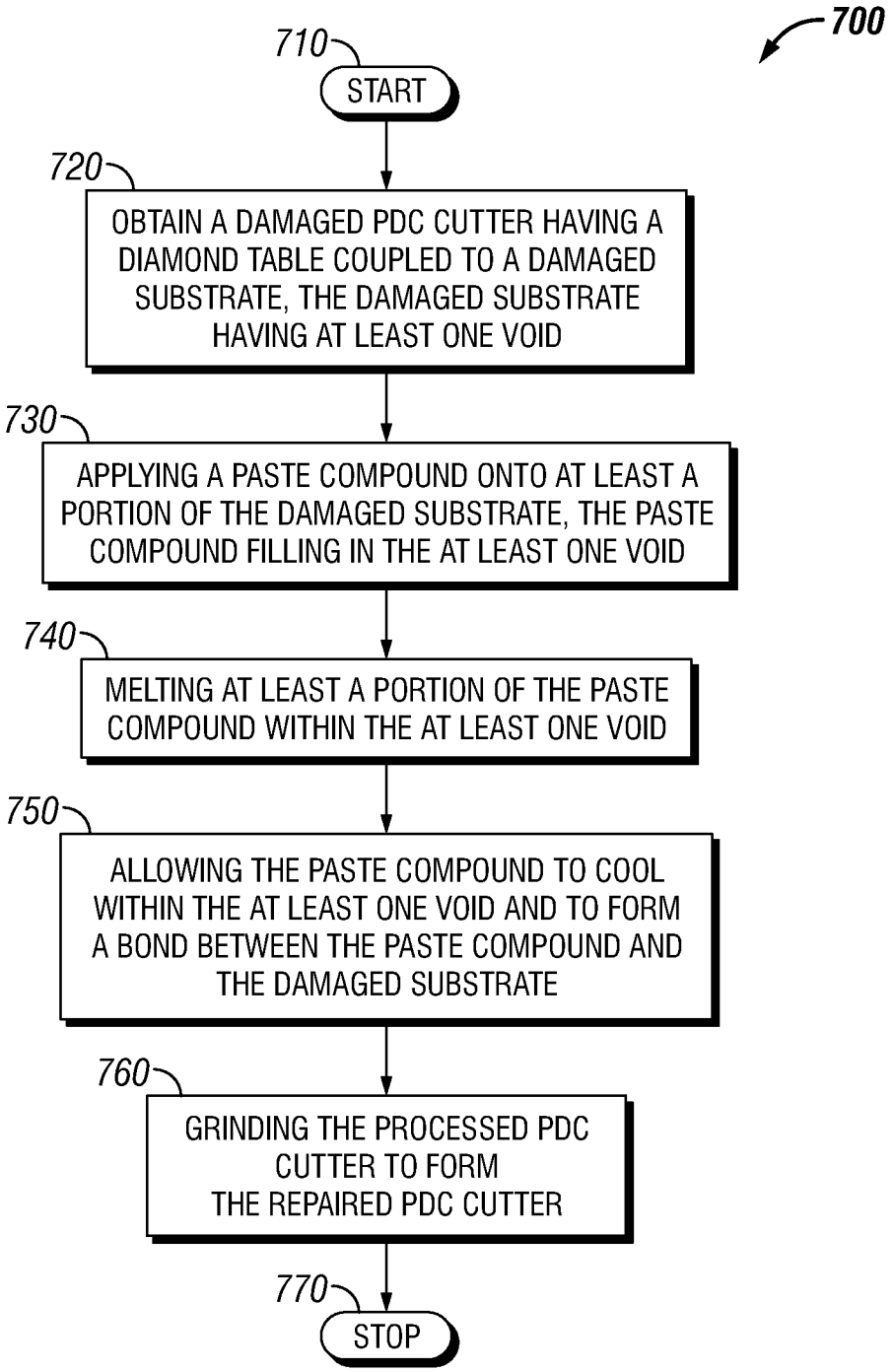
FIG. 7 is a flow chart illustrating a method for repairing a damaged PDC cutter, such as the PDC cutter of FIG. 8, in accordance with another exemplary embodiment of the present invention.
Figure 8:
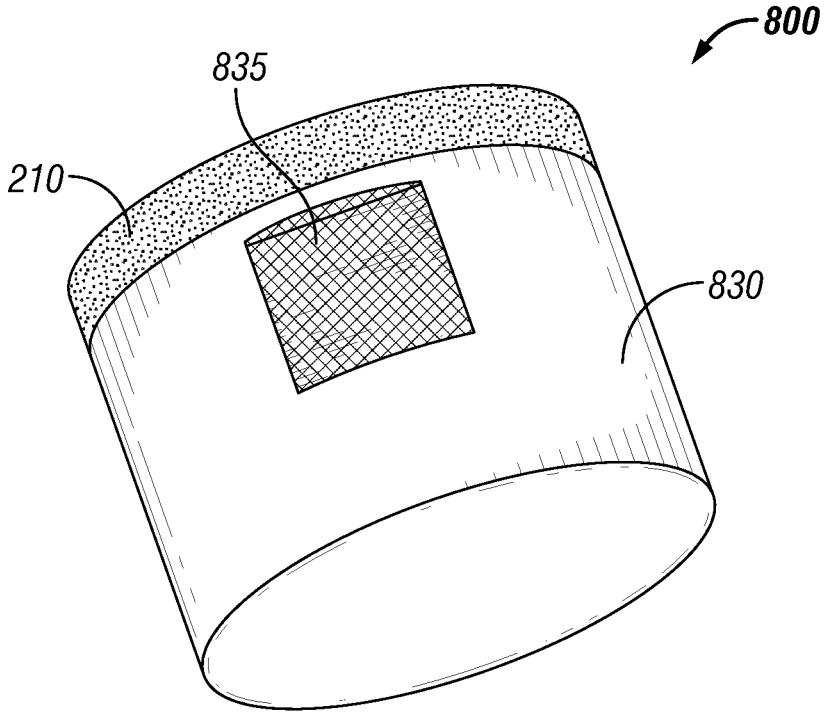
FIG. 8 shows a perspective view of a damaged PDC cutter in accordance with an exemplary embodiment of the present invention.

FIG. 7 is a flow chart illustrating a method for repairing a damaged PDC cutter 800, such as the PDC cutter of FIG. 8, in accordance with another exemplary embodiment of the present invention. Referring to FIG. 7, the method 700 starts at step 710.

FIG. 8 shows a perspective view of a damaged PDC cutter 800 in accordance with an exemplary embodiment of the present invention. Referring to FIGS. 7 and 8, after step 710, a damaged PDC cutter 800 having a diamond table 210 coupled to a damaged substrate 830 is obtained, where the damaged substrate 830 includes at least one void 835 therein at step 720. Although one illustration of the damaged cutter 800 has been shown, other types of damaged PDC cutters can be used in the exemplary embodiments where there is at least one void 835 present in the damaged substrate 830. Thus, in certain exemplary embodiments, the diamond table 210 may be damaged also. The configuration and shape of the PDC cutter 800 has been previously described and therefore is not described again for the sake of brevity.

Figure 9:
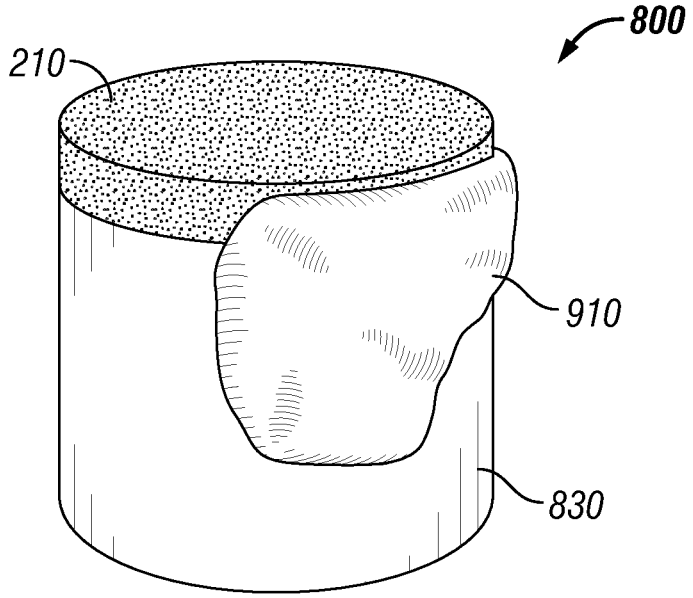
FIG. 9 shows a perspective view of the damaged PDC cutter of FIG. 8 having a paste compound applied thereto in accordance with an exemplary embodiment of the present invention.

FIG. 9 shows a perspective view of the damaged PDC cutter 800 of FIG. 8 having a paste compound 910 applied thereto in accordance with an exemplary embodiment of the present invention. Referring to FIGS. 7 and 9, after step 720, a paste compound 910 is applied onto at least a portion of the damaged substrate 830, the paste compound 910 filling in the at least one void 835 (FIG. 8) at step 730. A sufficient amount, such as a bead, of paste compound 910 is applied onto the damaged substrate 830 at the at least one void 835 (FIG. 8) such that the at least one void is completely filled. In certain exemplary embodiments, an amount of paste compound 910 is used such that at least a portion of the paste compound 910 is filled beyond the at least one void 835 (FIG. 8). Thus, at least a portion of the paste compound 835 (FIG. 8) is applied onto the damaged substrate 830 along the periphery of the void 835 (FIG. 8) where there is no void 835 (FIG. 8) and/or at least a portion of the paste compound 835 (FIG. 8) is applied onto at least a portion of the diamond table 210. The paste compound 910 is applied using tongs (not shown) according to some exemplary embodiments, but other devices may be used to apply the paste compound 910 in other exemplary embodiments. The process described herein is unique in that the copper braze filler material, or paste compound 910, can be loaded literally on top of the diamond table 210 and the copper braze filler material, or paste compound 910, will not wet the diamond table 210, but will flow and adhere well to the tungsten carbide, or substrate 830, adjacent to the diamond table 210. This is due to the surface energy difference between the diamond table 210 and the substrate 830. This unique feature allows for the repair of eroded/damaged substrate 830 immediately adjacent to the diamond table 210.

According to certain exemplary embodiments, the paste compound 910 is a copper based braze filler material, which is composed of copper powder, about 75% by weight, in a paste flux. The paste flux promotes reduction of oxides and enhances the flow of the braze filler material. The material of the paste flux is known to people having ordinary skill in the art and therefore is not described in detail herein. Although the copper powder has been mentioned as being about 75% by weight, this weight percent is only an example and may range from about 40% to about 90% in other exemplary embodiments. One example of this paste compound 910 is an off the shelf product from Fusion, Inc., whose part number is LHK-1310-650. In yet other exemplary embodiments, a nickel powder may be used in lieu of the copper powder in the braze filler material and in accordance with the same percentages mentioned above. Further, a combination of copper powder and nickel powder may be used in the braze filler material, where the above mentioned percentage ranges apply to the combination. Essentially, the metal used in the braze filler material can be any non-ferrous metal or alloy having a melting temperature higher than the melting temperature of a braze material that is used to braze the repaired cutter onto a drill bit or other downhole tool. Further, the temperature at which the non-ferrous metal commences melting is lower than the temperature at which the diamond table 210 is damaged, either through graphitization and/or through issues due to the different coefficient of thermal expansions of the diamond and the catalyst used in forming the diamond table 210, which is about 750 ° C. to about 800 ° C. Thus, the melting temperature of the non-ferrous metal may be somewhat higher than the temperature at which the diamond table 210 is damaged. This is due to the fact that the entire paste compound 910 does not reach the actual melting temperature of the non-ferrous metal used therein because it is only the commencement of melting that is used.

In addition to the examples provided above, tungsten carbide spheres may be added on top of the paste compound 910 to enhance wear resistance. These tungsten carbide spheres may be added to the paste compound 910 after the paste compound 910 has been applied onto the damaged substrate 830 and/or into the mix of the paste compound 910 prior to the paste compound 910 being applied onto the damaged substrate 830. Alternatively, according to some exemplary embodiments, the paste compound 910 includes encapsulated diamond particles in copper, nickel, or any non-ferrous metal or alloy as described above. Yet in other exemplary embodiments, encapsulated silicon carbide, encapsulated tungsten carbide, and/or encapsulated cubic boron nitride may be used in lieu of, or in addition to, the encapsulated diamond particles.

Figure 10:
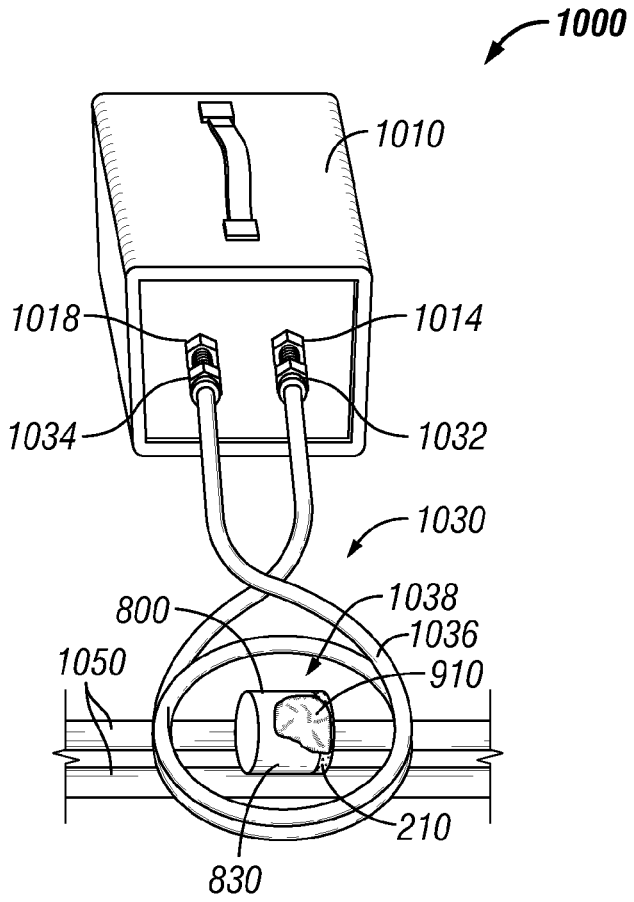
FIG. 10 shows a perspective view of an induction heating unit with the damaged PDC cutter of FIG. 9 having the paste compound applied thereto being positioned therein in accordance with an exemplary embodiment of the present invention.
Figure 11:
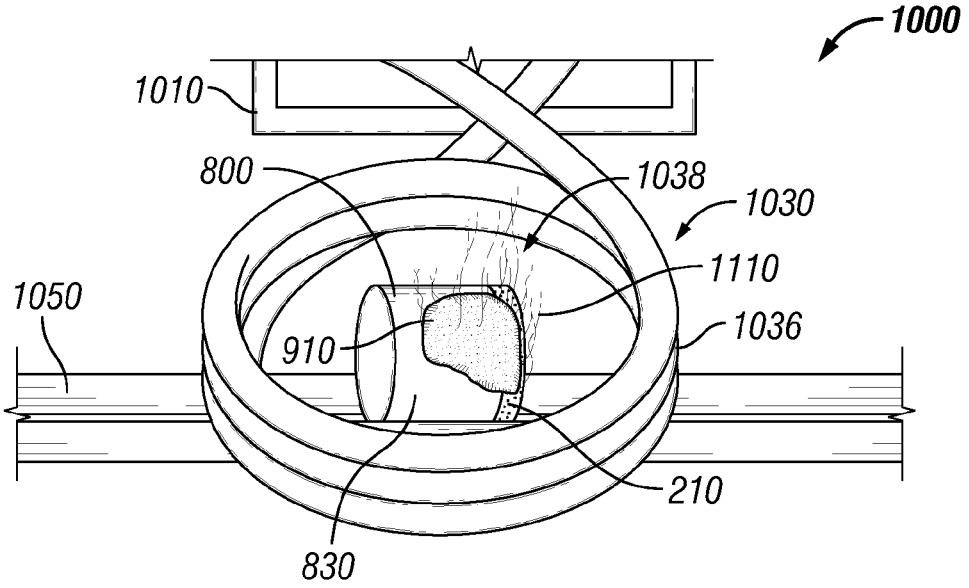
FIG. 11 shows a perspective view of the induction heating unit of FIG. 10 in operation in accordance with an exemplary embodiment of the present invention.

FIG. 10 shows a perspective view of an induction heating unit 1000 with the damaged PDC cutter 800 having the paste compound 910 applied thereto being positioned therein in accordance with an exemplary embodiment of the present invention. FIG. 11 shows a perspective view of the induction heating unit 1000 in operation in accordance with an exemplary embodiment of the present invention. Referring to FIGS. 7, 10, and 11, after step 730, at least a portion of the paste compound 910 is melted within the at least one void 835 (FIG. 8) at step 740.

According to some exemplary embodiments, the induction heating unit 1000 is used to melt the paste compound 910 within the at least one void 835 (FIG. 8). The induction heating unit 1000 includes a power control source 1010 and a coil 1030. The power control source 1010 includes an outlet port 1014 and an inlet port 1018. The power control source 1010 provides control for temperature and time that the temperature is applied. The coil 1030, or inductor, includes a first end 1032 and a second end 1034, where the first end 1032 is coupled to the outlet port 1014 and the second end 1034 is coupled to the inlet port 1018. The coil 1030 extends outwardly from the outlet port 1014, forms at least one loop 1036, and then extends into the inlet port 1018. According to some exemplary embodiments, the coil 1030 forms three loops 1036, but the number of loops can be greater or fewer in other exemplary embodiments. The loop 1036 forms a circular geometry and a channel 1038 formed therethrough according to some exemplary embodiments; however, the shape that is formed may be of a different geometric or non-geometric shape in other exemplary embodiments. According to some exemplary embodiments, the coil 1030, or inductor, is fabricated from a water cooled copper material. According to some exemplary embodiments, the induction heating unit 1000 is an Ambrell "Easy Heat" induction heating unit, but can be of another type in other exemplary embodiments.

According to some exemplary embodiments, the induction heating unit 1000 also includes at least one refractory material 1050 positioned below the loops 1036 of the coil 1030, thereby raising the coil 1030 so that it does not contact a surface that the coil 1030 would be resting on and/or the damaged cutter 800 would be resting on. According to some exemplary embodiments, the at least one refractory material 1050 includes one or more tubular components that provide an area for the damaged cutter 800 to be placed on.

In operating the induction heating unit 1000, the amperage is set at 260 amps. However, the amperage may be set to a different value such as 270 amps. Further, in other exemplary embodiments, the amperage is set between 180 amps and 330 amps. The precision control of time and temperature allows the paste compound 910 to be raised to a temperature just above the solidus of the non-ferrous material used therein, which is just high enough to induce flow of the paste compound 910 without excessive melting. The amperage is controllable to a tenth of an amp, while time is controllable to 0.01 seconds. Temperatures, which can be measured using an ICI infrared camera, indicate that the cutter temperature does not exceed 1200° F. during the brazing operation and thus damage to the diamond table 210 is minimized or non-existent. However, this temperature may be able to be over 1200° F., as mentioned above, in other exemplary embodiments.

The damaged cutter 800 that is to be repaired is placed inside the coil 1030 within the channel 1038 such that a portion of the coil 1030 surrounds the cutter 800. According to certain exemplary embodiments, the cutter 800 is resting, or being supported, on the refractory materials 1050. The power supply of the induction heating unit 1000 is turned on allowing alternating current to be passed through the coil 1030, thereby creating an alternating, or oscillating, magnetic field around the coil 1030 and hence inducing eddy currents into the cutter 800 causing the cutter 800 to heat up. According to some exemplary embodiments, the induction heating unit 1000 is on for about half a minute (30 seconds) at about 270 amps; however, the time is dependent upon the set amperage and the temperature that is desired. The eddy currents are induced in both the tungsten carbide substrate 830 and the diamond table 210, heating them both at once, at the "skin". Induction heating avoids the sudden application of heat, to one or the other, which gives rise to the coefficient of thermal expansion mismatch and hence induces stress within a part and causes it to crack. Induction heating allows for more uniform heating of the entire cutter 800. Although the induction heating unit 1000 is described as the equipment for performing the induction heating, any other heating equipment that provides induction heating and uniform heating of the entire cutter 800 can be used in alternative exemplary embodiments. Further, although induction heating has been described as the choice of heating process, other heating processes can be used in other alternative exemplary embodiments, so long as there is uniform heating of the entire cutter 800.

As the cutter 800 heats up, the paste compound 910 begins to form an outgas 1110 and activate. The outgas 1110 is a vapor formed mostly of water and flux. The flux used in the paste compound 910 reduces oxide formation and promotes the flow of the copper based braze filler metal, or other type of paste compound used as described above, which will flow into the void portion, or eroded/damaged portion, of the cutter 800 and effect the repair. Once the flow of the paste compound 910 initiates, the power supply is immediately turned off to prevent overheating and over melting. It is imperative to supply only enough power and heat to barely raise the temperature above the solidus of the braze filler material, or paste compound 910.

Figure 12:
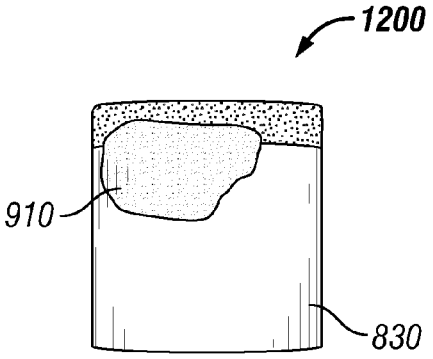
FIG. 12 shows a perspective view of a processed PDC cutter formed from the damaged PDC cutter of FIG. 9 having the paste compound applied thereto and being processed within the induction heating unit of FIG. 10 in accordance with an exemplary embodiment of the present invention.
Figure 13:
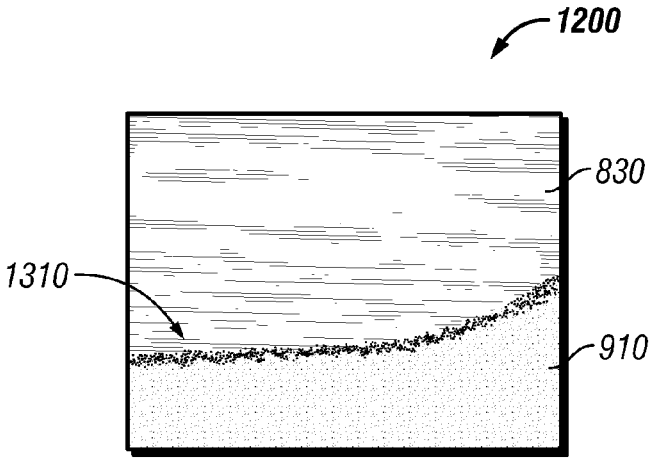
FIG. 13 shows a microscopic view of a bondline formed between the paste compound and the substrate upon forming the processed PDC cutter of FIG. 12 in accordance with an exemplary embodiment of the present invention.

FIG. 12 shows a perspective view of a processed PDC cutter 1200 formed from the damaged PDC cutter 800 having the paste compound 910 applied thereto and being processed within the induction heating unit 1100 in accordance with an exemplary embodiment of the present invention. FIG. 13 shows a microscopic view of a bondline 1310 formed between the paste compound 910 and the substrate 830 upon forming the processed PDC cutter 1200 in accordance with an exemplary embodiment of the present invention. Referring to FIGS. 7, 10, 12, and 13, after step 740, the paste compound 910 is allowed to cool with the at least one void 835 (FIG. 8) and form a bond 1310 between the paste compound 910 and the substrate 830 at step 750.

Upon turning the power off to the induction heating unit 1000, the cutter 800 is allowed to cool in certain exemplary embodiments. In other exemplary embodiments, the cutter 800 is removed from the induction heating unit 1000, and allowed to cool elsewhere. The cooling may be controlled in some exemplary embodiments, while in other exemplary embodiments, the cooling is allowed to occur naturally to room temperature. Once the cutter 800 has been cooled, the processed PDC cutter 1200 is formed and the paste compound 910 is properly bonded to the substrate 830. The paste compound 910 has solidified and may extend outwardly from the natural circumference of the substrate 830. The bond between the paste compound 910 and the substrate 830 forms a bondline 1310 and there are no cracks present at or adjacent to the bondline due to the uniform heating of the diamond table 210, the substrate 830, and the paste compound 910.

Figure 14:
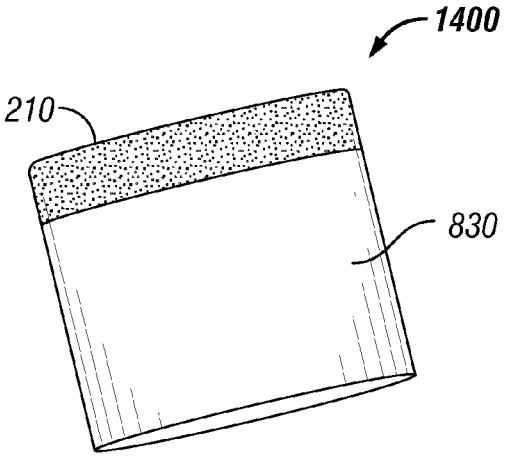
FIG. 14 shows a perspective view of a repaired PDC cutter formed from the processed PDC cutter of FIG. 12 in accordance with an exemplary embodiment of the present invention.

FIG. 14 shows a perspective view of a repaired PDC cutter 1400 formed from the processed PDC cutter 1200 (FIG. 12) in accordance with an exemplary embodiment of the present invention. Referring to FIGS. 7, 12, and 14, after step 750, the processed PDC cutter 1200 is ground to form the repaired PDC cutter 1400 at step 760. The processed PDC cutter 1200 is then centerless grinded, according to some exemplary embodiments, to restore the outer diameter wall of the substrate 830. This outer diameter wall has the same diameter has the diamond table 210 according to some exemplary embodiments; however, in other exemplary embodiments, the outer diameter wall may have a different dimension. This process has been previously described and is therefore not repeated again for the sake of brevity. Once the centerless grinding is completed, the repaired PDC cutter 1400 has a uniform outer diameter wall and forms a braze gap of between 0.002 and 0.005 inches once positioned within the cutter pockets of a drill bit or other downhole tool.

After step 760, the repair method 700 stops at step 770. Although method 700 has been depicted herein with respect to certain steps, these steps are not limited to the order in which they are presented, but instead, may be performed in a different order in other exemplary embodiments. Further, some steps may be separated into additional steps. Alternatively, some steps may be combined into fewer steps. Furthermore, some steps may be performed in an entirely different manner than the example provided herein and are understood to be included within the exemplary embodiments.

The methods for repairing cutters, as described above, are performed on PDC cutters, whether they have been pre-processed, post-processed, or not processed at all. Some processing examples, which are not meant to be limiting, include leaching, annealing, cryogenic treatment, chemical vapor deposition, or creating a new or larger sized chamfer on the diamond table 210, which are known to people having ordinary skill in the art. Leaching includes face leaching, side leaching, bevel leaching, and/or double bevel leaching, which are terms known to people having ordinary skill in the art. Masking may also be used during the processing. Thus, for example, a PDC cutter that has previously been leached and damaged during use is subjected to any of the repair methods described above. This is an example of repairing a PDC cutter that has been pre-processed. In another example, a PDC cutter that has not been pre-processed and damaged during use is subjected to any of the repair methods described above and then subsequently leached. This is an example of post-processing a repaired PDC cutter.

Exemplary embodiments allow for a more complete use of expensive PDC components, which includes the re-use of damaged PDC components, in drill bits and tools. These exemplary embodiments facilitate in reducing costs and enhancing the retention of cutters that are reused after wear or erosion. These exemplary embodiments offer a more far superior solution than scrapping or wire EDM cutting cutters. Cutters are now salvageable by using the exemplary embodiments, as described above.

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A method for repairing a damaged cutter, the method comprising:

obtaining a damaged polycrystalline diamond cutter comprising:

a damaged substrate defining at least one void therein, the at least one void resulting from downhole use of the cutter; and a polycrystalline diamond table coupled to a surface of the damaged substrate;

applying a paste compound onto at least a portion of the damaged substrate, the paste compound filling in the at least one void;

melting at least a portion of the paste compound within the at least one void;

cooling the paste compound within the at least one void and forming a bond between the paste compound and the damaged substrate, the damaged polycrystalline diamond cutter forming a processed cutter; and removing a portion of the paste compound from the processed cutter and forming a repaired cutter, wherein the paste compound comprises at least a non-ferrous metal material and flux, and wherein the non-ferrous metal material comprises a melting temperature higher than a melting temperature of a braze material used to braze the repaired cutter onto a downhole tool and commences melting at a temperature lower than a temperature that damages the polycrystalline diamond table.

2. The method of claim 1, wherein the non-ferrous metal material is selected from at least one of a copper material, a nickel material, or alloys of a copper or nickel material.

3. The method of claim 1, wherein the paste compound further comprises at least one of encapsulated tungsten carbide particles, encapsulated diamond particles, encapsulated silicon carbide particles, or encapsulated cubic boron nitride particles within the non-ferrous metal material.

4. The method of claim 1, further comprising placing at least one of encapsulated tungsten carbide particles, encapsulated diamond particles, encapsulated silicon carbide particles, or encapsulated cubic boron nitride particles onto an exposed surface of the paste compound once the paste compound is applied onto the damaged substrate.

5. The method of claim 1, wherein the paste compound comprises a melting temperature less than about 700 ° C.

6. The method of claim 1, wherein melting at least a portion of the paste compound comprises maintaining the temperature of the polycrystalline diamond table of the damaged polycrystalline diamond cutter less than about 700 ° C.

7. The method of claim 1, wherein the repaired cutter comprises the polycrystalline diamond table and a repaired substrate coupled to the polycrystalline diamond table, the repaired substrate comprising the damaged substrate and the paste compound sintered and disposed within the at least one void.

8. The method of claim 7, wherein the diameter of the polycrystalline diamond table and the diameter of the repaired substrate are same.

9. The method of claim 1, wherein melting at least a portion of the paste compound is performed using an induction heating unit.

10. The method of claim 9, wherein the induction heating unit comprises:

a power source comprising an outlet and an inlet; and a coil comprising a first end, a second end, and a loop formed between the first end and the second end and forming a channel therethrough, the first end being coupled to the outlet end and the second end coupled to the inlet end.

11. The method of claim 10, wherein melting at least a portion of the paste compound further comprises placing the damaged cutter within the channel.

12. The method of claim 10, wherein melting at least a portion of the paste compound further comprises turning on the induction heating unit to generate heat into the damaged cutter, and turning off the induction heating unit once the paste compound commences melting.

13. The method of claim 1, wherein removing a portion of the paste compound from the processed cutter and forming a repaired cutter comprises using a grinder.

14. A repaired polycrystalline cutter, comprising:

a damaged substrate defining at least one void therein, the at least one void being irregular as a result of downhole use of the cutter;

a polycrystalline diamond table coupled to the damaged substrate; and a paste compound disposed within the at least one void of the damaged substrate and coupled to the damaged substrate;

wherein the damaged substrate and the paste compound collectively form a full circumference, wherein the paste compound comprises at least a non-ferrous metal material and flux and wherein the non-ferrous metal material comprises a melting temperature higher than a melting temperature of a braze material used to braze the repaired cutter onto a downhole tool and commences melting at a temperature lower than a temperature that damages the polycrystalline diamond table.

15. The repaired polycrystalline cutter of claim 14, wherein the non-ferrous metal material is selected from at least one of a copper material, a nickel material, or alloys of a copper or nickel material.

16. The repaired polycrystalline cutter of claim 14, wherein the paste compound further comprises at least one of encapsulated tungsten carbide particles, encapsulated diamond particles, encapsulated silicon carbide particles, or encapsulated cubic boron nitride particles within the non-ferrous metal material.

17. The repaired polycrystalline cutter of claim 14, further comprising an amount of at least one of encapsulated tungsten carbide particles, encapsulated diamond particles, encapsulated silicon carbide particles, or encapsulated cubic boron nitride particles coupled to an exposed surface of the paste compound.

18. The repaired polycrystalline cutter of claim 14, wherein the paste compound comprises a melting temperature less than about 700 ° C.

19. A downhole tool, comprising:

a repaired polycrystalline cutter, comprising:

a damaged substrate defining at least one void therein, the at least one void being irregular as a result of downhole use of the cutter;

a polycrystalline diamond table coupled to the damaged substrate; and a paste compound disposed within the at least one void of the damaged substrate and coupled to the damaged substrate;

wherein the damaged substrate and the paste compound collectively form a full circumference wherein the paste compound comprises at least a non-ferrous metal material and flux, and wherein the non-ferrous metal material comprises a melting temperature higher than a melting temperature of a braze material used to braze the repaired cutter onto the downhole tool and commences melting at a temperature lower than a temperature that damages the polycrystalline diamond table.

20. The downhole tool of claim 19, wherein the non-ferrous metal material is selected from at least one of a copper material, a nickel material, or alloys of a copper or nickel material.

21. The downhole tool of claim 19, wherein the paste compound further comprises at least one of encapsulated tungsten carbide particles, encapsulated diamond particles, encapsulated silicon carbide particles, or encapsulated cubic boron nitride particles within the non-ferrous metal material.

22. The downhole tool of claim 19, further comprising an amount of at least one of encapsulated tungsten carbide particles, encapsulated diamond particles, encapsulated silicon carbide particles, or encapsulated cubic boron nitride particles coupled to an exposed surface of the paste compound.

23. The downhole tool of claim 19, wherein the paste compound comprises a melting temperature less than about 700 ° C.

* * * * *